US006617000B1

(12) United States Patent
Denny et al.

(10) Patent No.: US 6,617,000 B1
(45) Date of Patent: Sep. 9, 2003

(54) ADHESIVE LABELS AND MANUFACTURE THEREOF

(75) Inventors: Barry Denny, Bury St Edmunds (GB); Andrew Denny, Bury St Edmunds (GB)

(73) Assignee: Denny Bros. Printing Ltd., Suffolk (GB)

( * ) Notice: Subject to any disclaimer, the term of this patent is extended or adjusted under 35 U.S.C. 154(b) by 0 days.

(21) Appl. No.: 09/786,314

(22) PCT Filed: Sep. 6, 1999

(86) PCT No.: PCT/GB99/02948

§ 371 (c)(1),
(2), (4) Date: May 15, 2001

(87) PCT Pub. No.: WO00/13884

PCT Pub. Date: Mar. 16, 2000

(30) Foreign Application Priority Data

Sep. 4, 1998 (GB) ..... 9819361

(51) Int. Cl.[7] ..... G09F 3/00

(52) U.S. Cl. ..... 428/40.1; 156/247; 156/248; 156/250; 156/267; 156/269; 156/270; 281/2; 281/5; 283/81; 428/41.7; 428/41.8; 428/42.1; 428/42.2; 428/42.3; 428/43; 428/192; 428/194; 428/914

(58) Field of Search ..... 428/40.1, 41.7, 428/41.8, 42.1, 42.2, 42.3, 43, 192, 194, 914; 281/2, 5; 283/81; 156/247, 250, 248, 267, 269, 270

(56) References Cited

U.S. PATENT DOCUMENTS

| | | | | |
|---|---|---|---|---|
| 5,588,239 A | | 12/1996 | Anderson | |
| 5,944,357 A | * | 8/1999 | Instance | 283/101 |
| 6,413,603 B1 | * | 7/2002 | Horton | 428/40.1 |

FOREIGN PATENT DOCUMENTS

| | | |
|---|---|---|
| EP | 0628941 | 12/1994 |
| EP | 0650154 | 4/1995 |
| GB | 2164915 | 4/1986 |
| WO | 92/04703 | 3/1992 |
| WO | 95/34421 | 12/1995 |
| WO | 98/07133 | 2/1998 |

* cited by examiner

*Primary Examiner*—Nasser Ahmad
(74) *Attorney, Agent, or Firm*—Wenderoth, Lind & Ponack, L.L.P.

(57) ABSTRACT

Adhesive labels are manufactured by cutting windows in an upper layer of a support web (2) through to a lower silicon coated material. Folded leaflets (15) are then adhered by lines of adhesive (11, 12, 13) to the support web (2) and the combination is die-cut to form individual adhesive labels with part of the die-cut folded leaflet extending beyond an edge of a base label formed from the window in the support web. This method of manufacture permits more complex label structures to be constructed without pre-cutting individual base labels.

19 Claims, 5 Drawing Sheets

ADHESIVE LABELS AND MANUFACTURE THEREOF

BACKGROUND OF THE INVENTION

The present invention relates to adhesive labels and to the manufacture thereof In particular, the present invention is concerned with a method of manufacture of adhesive labels that affords greater flexibility in the construction of the adhesive labels and improvements in the economy of production. Moreover, the present invention is further concerned with adhesive labels manufactured by such a method that are particularly suited for use on cylindrical and other non-planar surfaces.

Numerous variations of self-adhesive label designs have been developed for the packaging industry to enable additional information to be provided with a host product or its packaging. In general, such labels are provided on a reel of silicone-lined release material to permit automated transfer of the self-adhesive labels from the release material to the host product or packaging One example of the many different designs of self-adhesive labels available may be found in EP 0628941. Reference is made in particular to FIG. 13 of EP 0628941 which shows a web of release material to which a web of supporting labels is adhered by a layer of adhesive. The web of supporting labels is initially cut and the waste removed to define a series of individual labels, spaced apart from one another, each of which is larger than its desired final size. A layer of adhesive is then applied over the top surface of each of the support labels and beyond one edge of the support label to overlie the release material. Individual folded leaflets are adhered by the continuous layer of adhesive to respective support labels so that the top panel of the folded leaflet extends beyond the one edge of the support label to adhere to the adhesive overlying the release material. Finally, a layer of transparent laminar material is applied over the support label and the folded leaflet and the layered structure is cut to the desired shape with the waste being removed.

The method of manufacture of the self-adhesive label design described above presents a number of disadvantages to the commercial production of self-adhesive labels of this type. For example, the fact that a layer of adhesive is used results in the entire free edge region of the top panel overlying the release material being permanently adhered to the host product making the label difficult to open and increasing its stiffness making the label inappropriate for use on highly curved surfaces. Furthermore, the entire lower surface of the folded leaflet is secured to the support label thereby preventing the lower surface of the bottom panel and that part of the upper surface of the support label beneath the bottom panel being used to present additional printed information. It should be noted that the method of manufacture described above requires the support labels to be individually formed before the folded leaflets are applied. This limits the manufacturing method to single leaflet application to support labels, increases the complexity of the initial manufacturing steps, and increases the need for accurate alignment between the support labels and the folded leaflets.

SUMMARY OF THE INVENTION

The present invention seeks to overcome at least some of the disadvantages described above and seeks to provide a novel method of manufacturing adhesive labels and to an improved adhesive label manufactured by such a method.

The present invention provides a method of manufacturing adhesive labels consisting of a base label and a multi-page leaflet secured thereto, the method comprising the steps of: providing a support web on a web of release material, the support web having a plurality of windows exposing portions of the web of release material therethrough; securing a plurality of multi-page leaflets to a top surface of the support web such that an end region of each multi-page leaflet overlies one or more windows: and cutting the multi-page leaflets and the support web to define a plurality of adhesive labels each having a portion of the multi-page leaflet adjacent the web of release material.

Preferably, the-multi-page leaflets are secured to the support web by one or more regions of adhesive. Ideally, one or more lines of permanent adhesive are used to secure the multi-page leaflet to the support web.

In a preferred embodiment adhesive is applied to regions of the release material exposed through the windows in the support web so that said portion of the multi-page leaflet is adhered directly to the web of release material. The end region of the multi-page leaflet may include an unadhered tab portion extending beyond the portion of the multi-page leaflet adhered to the web of release material.

Whilst any one of many different methods may be employed to remove the cut patches the preferred method is one in which the cut patches of the support web are removed by supplying the web of release material and the web of label material to a projecting edge, with the web of label material facing away from the surface of the projecting edge, and passing the support web over the projecting edge thereby causing the cut patches to fall away from the web of release material. Ideally, the web of release material and the web of label material are fed to the projecting edge in a direction that ensures the adhesive surface of the removed patches face generally upwards.

The method may further include providing a covering layer of a laminate material over at least a part of the support web and the multi-page leaflets. Ideally, the covering laminate material is applied to the support web and the multi-page leaflets prior to the cutting of the multi-page leaflets and the support web into individual adhesive labels.

In a further aspect the present invention provides a method of manufacturing an adhesive label assembly which comprises the steps of: providing a continuous web of adhesive label material on a-web of release material; cutting a plurality of windows in the web of label material as far as the web of release material; and disposing of the cut patches of the web of label material.

The present invention also provides an adhesive leaflet manufactured in accordance with the method described above and an adhesive label assembly manufacture in accordance with the method described above.

The present invention further provides an adhesive leaflet assembly comprising a web of release material, a plurality of base labels formed from a support web and releasably adhered to the web of release material, a multi-page leaflet disposed on each one of the plurality of base labels such that an end region of each multi-page leaflet extends beyond an edge of the respective base label to overlie a window exposing a portion of the release material.

Preferably, the exposed upper surface of the base label and the upper surface of the multi-page leaflet are uncovered and do not include a transparent laminar material.

BRIEF DESCRIPTION OF THE DRAWINGS

Embodiments of the present invention will now be described by way of example with reference to and as shown in the accompanying drawings in which.

DETAILED DESCRIPTION OF THE INVENTION

Figure 2:
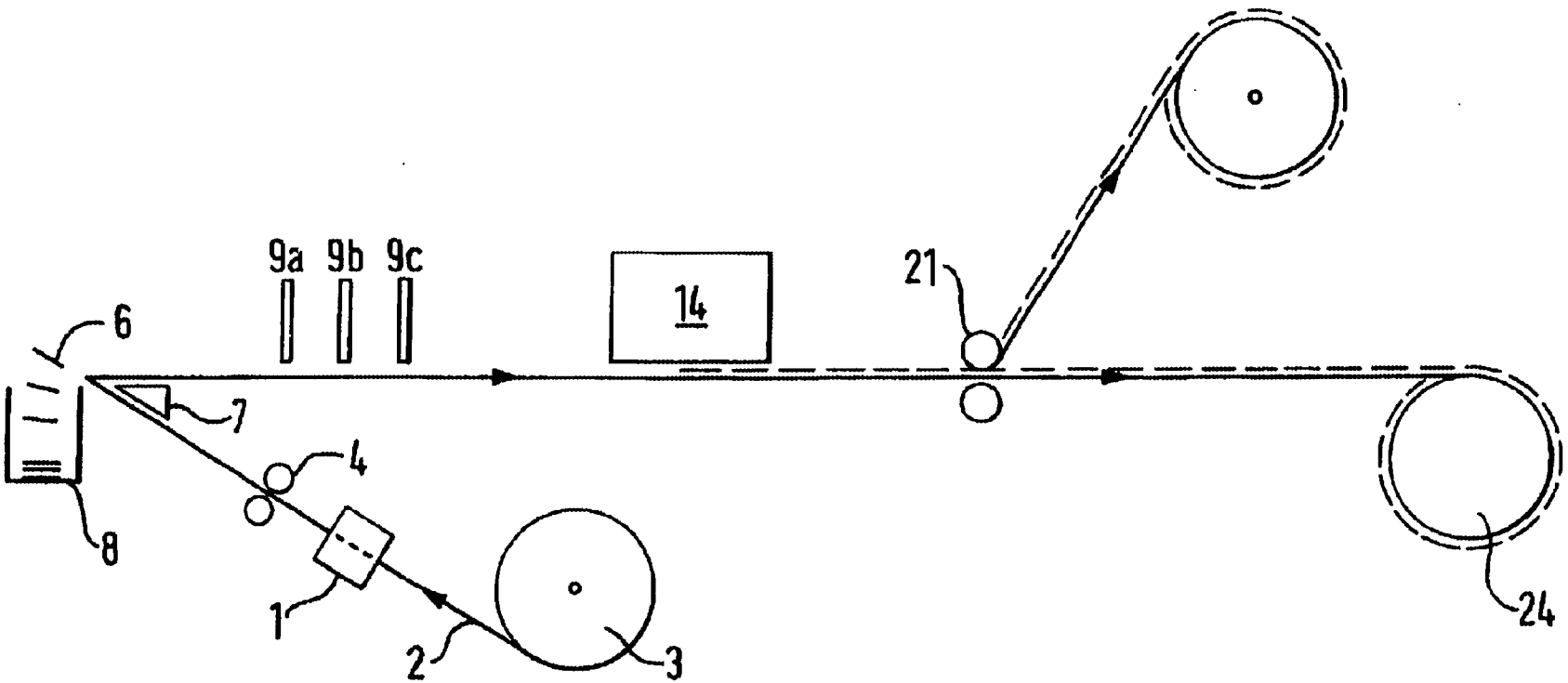
FIG. 2 is a diagram of apparatus for performing the method of manufacturing an adhesive label in accordance with the present invention.

The method of manufacturing adhesive labels diagrammatically represented in FIG. 2 starts with a base or support web 2 stored on a reel 3. The support web 2 comprises a silicone coated release material having a layer of adhesive thereon and a top support layer with the top support layer facing outwardly on the reel 3. The support web 2 is initially printed at a printing station 1 with the desired image along with any index and leaflet registration markings The images and the index and registration markings are repeated along the longitudinal length of the support web 2, the longitudinal direction being parallel to the direction of motion of the support web during the manufacturing process. Also, there may be multiple images printed across the transverse width of the support web. Although it is convenient to print the registration markings on the support web, as an alternative the indexing and registration markings may be stamped or cut into the support web, preferably adjacent one or both edges of the support web.

Figure 3:
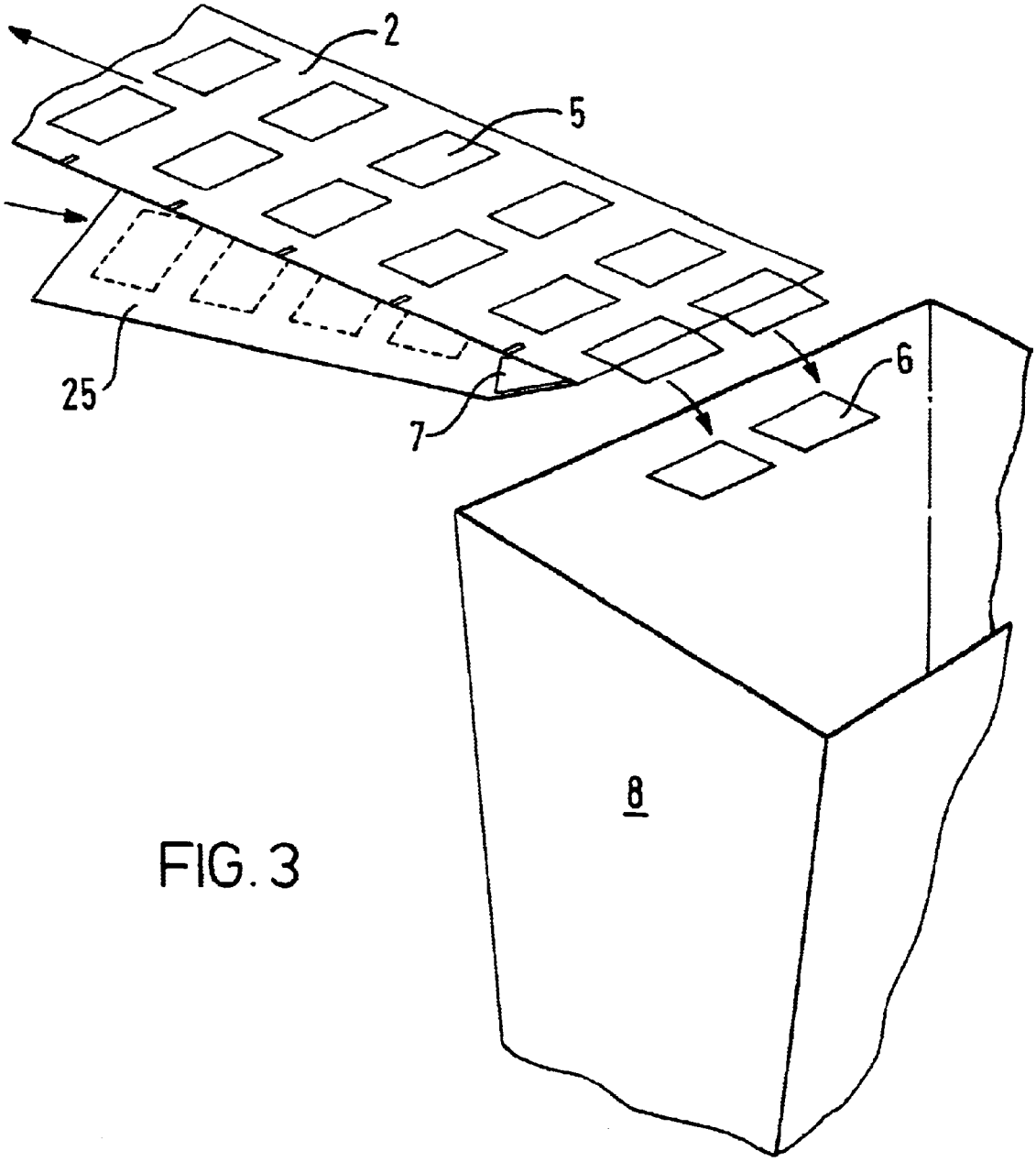
FIG. 3 shows schematically an initial stage in the method of manufacturing an adhesive label in accordance with the present invention.

From the printing station 1, the support web 2 is supplied to a die-cutting station 4 at which windows 5 are cut through the upper support layer but not through the release material leaving patches 6 unconnected to the remainder of the upper support layer. In FIG. 3 the windows are shown as being generally rectangular. However, alternative shapes may be cut out from the upper support layer as required including shapes having curved or irregular edges. The locations of the windows are determined using the indexing marks printed on the upper support layer and are aligned with any existing printed images on the upper support layer The patches 6 are removed from the support web 2 to form the windows 5, for example employing a dispensing beak 7, more clearly shown in FIG. 3, where the patches 6 are received in a waste bin 8.

The dispensing beak 7 is generally triangular in cross-section, preferably a right-angled triangle, with the most acute angle of the triangle being the edge over which the support web travels. It will, of course, be appreciated that alternative arrangements of the dispensing beak 7 may be used to remove the patches 6 from the windows 5.

The support web 2 with the windows 5 may be manufactured separately and supplied to the machinery on a reel as an adhesive label assembly or, as shown in FIG. 2, the formation of the windows may be part of a continuous in-line manufacturing process. As can be seen from FIGS. 2 and 3, where formation of the windows 5 is part of a continuous label manufacturing process, the support web 2 is fed to the printing station 1 and the die-cutting station 4 with the upper support layer facing downwardly (as seen in FIG. 2) This ensures that when the upper support layer 2 is fed to the dispensing beak 7, the upper support layer faces outwardly from the dispensing beak 7. This ensures that the patches 6 can be easily removed and the upper support layer is uppermost in the subsequent manufacturing steps. Moreover, the support web 2 is preferably fed initially to the lower leading surface of the projecting edge of the dispensing beak 7 and then over the edge of the beak to its upper supporting surface so that the patches 6 fall with their adhesive surface uppermost. It is envisaged that the patches 6 could be collected and reused in other label products.

Conventionally the dispensing beak 7 is used to remove self-adhesive labels from release material when the self-adhesive labels are being applied to a host product or packaging. This requires the self-adhesive labels to be removed from the release web with the adhesive side of the labels directed downwardly. To do so, the web of release material bearing the individual self-adhesive labels is supplied to the upper surface of the dispensing beak and is then passed over the point of the dispensing beak and around to the lower surface of the beak. However, with the manufacturing method shown in FIG. 3, as the patches 6 are a waste by-product in this process, rather than the final label product, the normal operation of the dispensing beak 7 is undesirable. Hence, the support web 2 is preferably supplied to the dispensing beak 7 in the opposite direction, i.e. initially to the lower surface of the dispensing beak, to ensure that the patches fall into the waste bin 8 with the adhesive uppermost and the upper support layer is uppermost in the subsequent manufacturing steps.

Instead of individual windows being manufactured by this method a continuous transverse strip may be die-cut from the upper support layer at regular intervals along the longitudinal length of the support web and removed using the dispensing beak 7. Where a continuous strip is removed from the support web 2, the edges of the strip may include a repeating pattern of curves or steps depending upon the desired final shape of the adhesive label. One of the edges of the window will, ultimately, form an edge of a base label cut from the support web. Whether individual windows or a continuous transverse strip is cut from the support web 2, at least in the transverse direction, the support web remains a sheet overlying the release material and is not divided into individual base labels.

Figure 4:
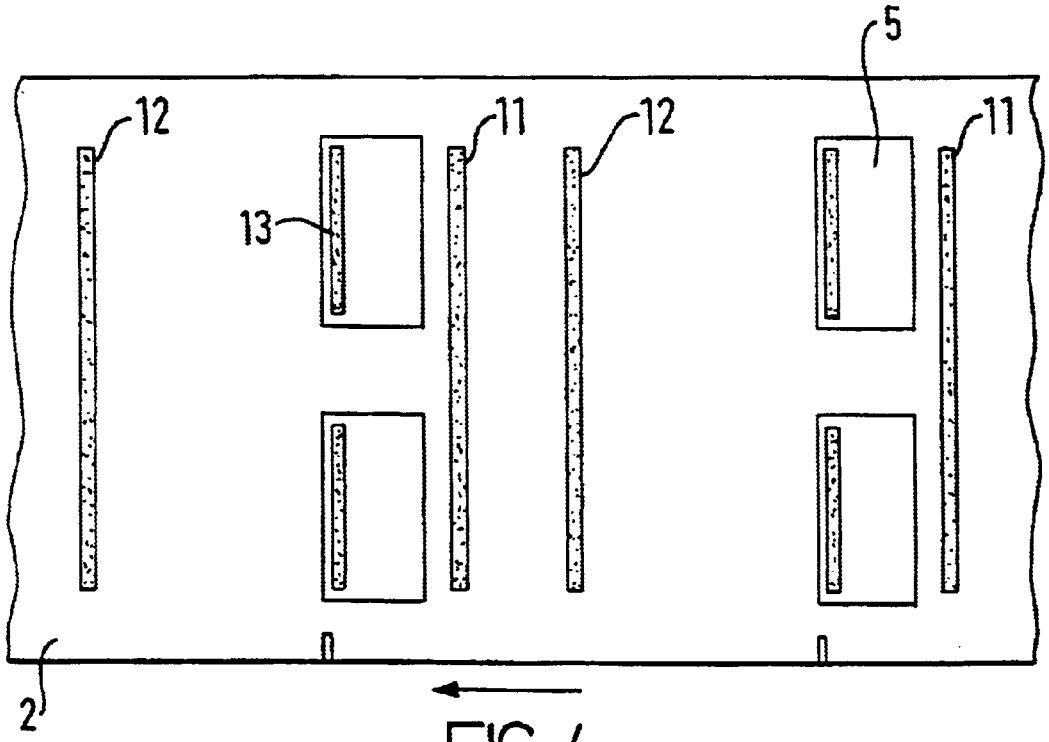
FIG. 4 shows schematically a further stage in the method of manufacturing an adhesive label is accordance with the present invention.

Once the windows 5 have been formed, lines of adhesive are applied to the upper support layer and to the exposed release material in the windows. Three adhesive dispensers 9*a*, 9*b* and 9*c* are shown in FIG. 2, the first and third dispensers 9*a* and 9*c* apply permanent adhesive whereas the second dispenser 9*b* applies releasable adhesive. The dispensers 9*a*, 9*b* and 9*c* may be operated simultaneously or sequentially, as desired. In FIG. 4 the location of the lines of adhesive are shown and consist of: a first line of permanent adhesive 11 extending across the support web 2 in a transverse direction adjacent the windows 5 applied by the first dispenser 9*a*; a second transverse line of permanent adhesive 12 on the support web 2, parallel to the first line of permanent adhesive 11, located distant from the windows 5, applied by the third dispenser 9*c*; and a third line of resealable adhesive 13 on the release material, parallel to the first line of permanent adhesive, located within each of the windows 5 applied by the second dispenser 9*b*. The alignment of the lines of adhesive is ensured using conventional indexing techniques and the adhesives are applied using conventional techniques, for example-hot or cold nozzle application in either intermittent or continuous motions. Alternatively, lines of adhesive can be printed onto the support web 2 and the release material, Ideally, the same adhesive is applied by all three dispensers 9*a*, 9*b* and 9*c* for example Danikumlin 5818 and the material in contact with the adhesive determines whether the adhesive forms a permanent, or releasable contact. Alternatively, different adhesives may be applied by the individual dispensers, for example Addex 100 in dispensers 9*a* and 9*c* and Danikumlin 5213 in dispenser 9*b*.

Figure 5:
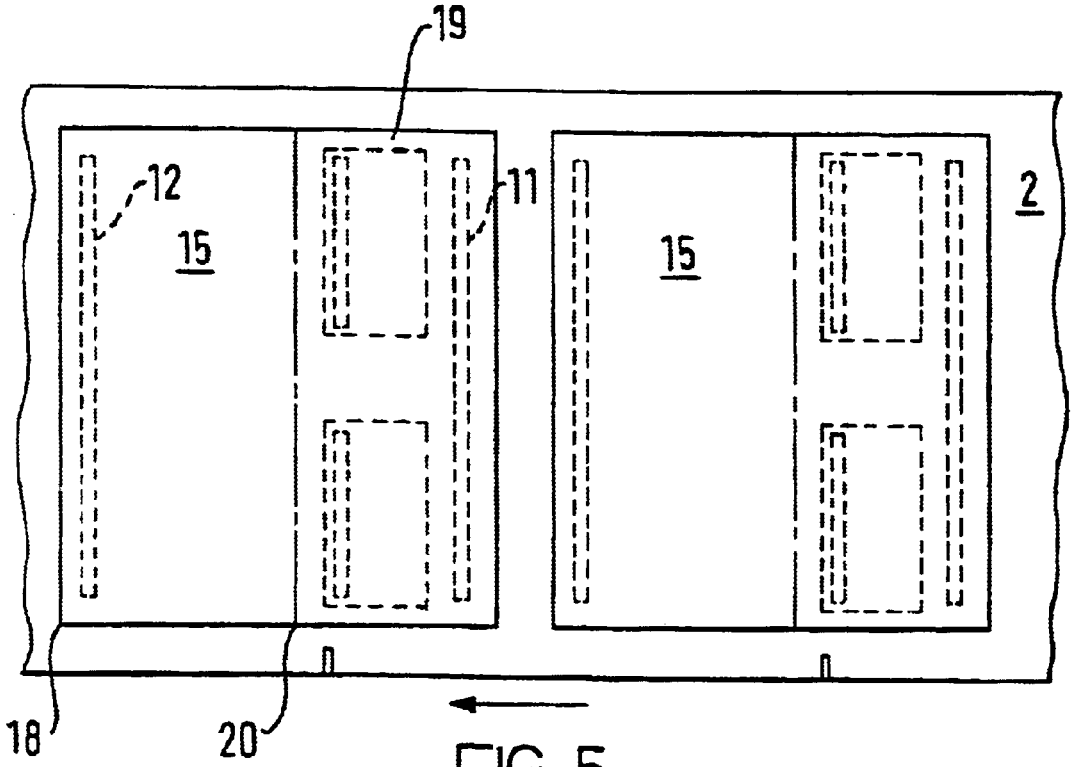
FIG. 5 shows schematically a subsequent stage in the method of manufacturing an adhesive label in accordance with the present invention.
Figure 6:
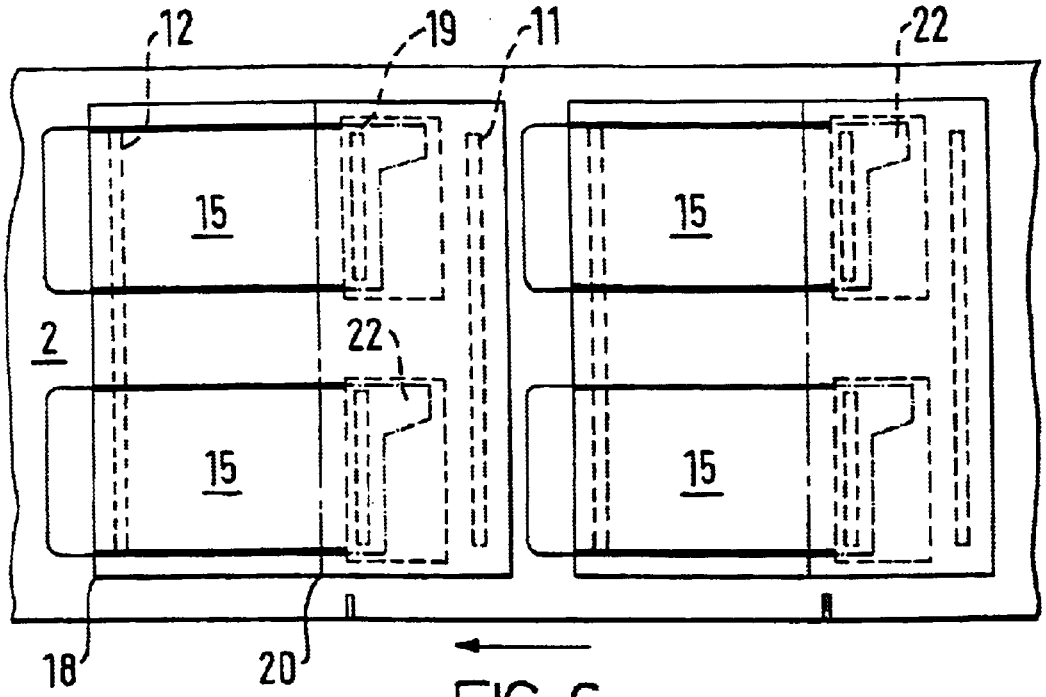
FIG. 6 shows schematically one of the final stages in the method of manufacturing an adhesive label in accordance with the present invention.

Once the lines of adhesive 11, 12, 13 have been applied to the support web 2 the support web is fed to a leaflet dispensing station 14. At the leaflet dispensing station 14, multi-page leaflets such as folded leaflets or booklets 15 are applied to the upper surface of the support web over the lines of adhesive 11, 12, 13. The positioning of the folded leaflets 15 over the lines of adhesive is performed using conventional registration techniques and any registration markings printed on the upper surface of the support web 2. Preferably, the folded leaflets 15 are applied with their folded edge or spine facing towards the direction of travel of the support web. The direction of travel of the support web is indicated by an arrow in FIGS. 4 to 6.

Where more than one window or a continuous strip has been die-cut in a transverse direction across the support web with the intention of manufacturing two or more adhesive labels across the width of the support web, as shown in FIGS. 4, 5 and 6, the folded leaflet 15 applied to the support web 2 preferably extends across all of the windows 5 and the support web in a transverse line. In this case the folded leaflet 15 is printed with multiple identical images according to the number of windows extending across the transverse width of the support web 2. Alternatively, the folded leaflet may be printed with different images for different transverse regions of the support web 2 or a plurality of separate folded leaflets with different printed images may be applied across the transverse width of the support web 2.

Each folded leaflet 15 consists of a bottom panel connected to a top panel along a folded edge 18. Inner panels or pages may additionally be provided between the top and bottom panels and are preferably connected to the bottom panel along a further folded edge located beneath the top panel. The inner pages may be folded in either a zig-zag or circular arrangement. Alternatively the inner pages may be secured between the top and bottom panels by means of a suitable adhesive or by means of a stapled construction. In all cases, however, a free end region 19 of the leaflet extends beyond the edge of the windows 5. Preferably, the free end region 19 is an extension of the top panel that extends beyond the edge of the bottom panel 20 and the edges of any inner pages, distant from the folded edge 18.

The folded leaflet 15 is aligned with the lines of adhesive such that the free end region 19 overlies the windows 5 with the resealable lines of adhesive 13 and the first line of permanent adhesive 11. The folded edge 18 of the leaflet is positioned beyond but close to the second line of permanent adhesive 12. In this way the folded leaflet 15 is held securely to the support web 2 at both transverse ends during the manufacturing process. In this position the edge of the bottom panel 20, distant from the folded edge 18, and the edges of any inner pages are positioned between the second line of permanent adhesive 12 and the windows 5. Preferably, the edge of the bottom panel 20 is close to the edge of the windows 5.

The support web 2 bearing the folded leaflets 15 then travels to a die-cutting station 21. At the die-cutting station either simultaneously or consecutively the support web and the folded leaflets are cut using flat-bed or rotary cutting apparatus to the desired size and shape. During this cutting operation as shown in FIG. 6, the upper support layer and underlying layer of adhesive of the support web 2 is cut in one region down to but not through the release material. In a second region the folded leaflet 15, the second line of adhesive 12, the upper support layer and the underlying layer of adhesive are cut through as far as but not through the release material. In a third region the free end region 19 of the top panel only is cut, over the window 5. In FIG. 6 the thinner line indicates where the first region is cut, the thicker line indicates where the second region is cut and the dashed line indicates where the third region is cut.

With this method of manufacture the folded leaflet 15, the support web 2 and the free end region 19 of the top panel may be cut to any desired shape be it rectangular or generally circular, for example.

Moreover, the free end region 19 of the top panel may be shaped to define a tab 22, unadhered to the underlying release material, beyond the line of resealable adhesive 13. The tab 22 is an aid to the opening and closing of the folded leaflet when the adhesive label is applied to a host product or packaging.

As can be seen from FIG. 6 it is at this stage that the folded leaflet 15 is divided into individual folded leaflets, one for each window across the transverse width of the support web It should be borne in mind that until this final die-cutting step the upper support layer of the support web 2 has not been divided into individual base labels. Instead, up to this die-cutting operation the upper support layer remains a sheet overlying the release material having a plurality of individual windows or continuous transverse strips cut out therefrom.

Once the die-cutting is completed the waste material 23 is removed and the release material bearing individual adhesive labels is stored on a reel 24. It will be apparent that the waste material 23 includes the entirety of the first line of permanent adhesive 11. Before being collected on a reel, where two or more individual adhesive labels are arranged across the transverse width of the release material, the release material may be slit between the adhesive labels to form single width reels of base labels and folded leaflets.

Figure 1:
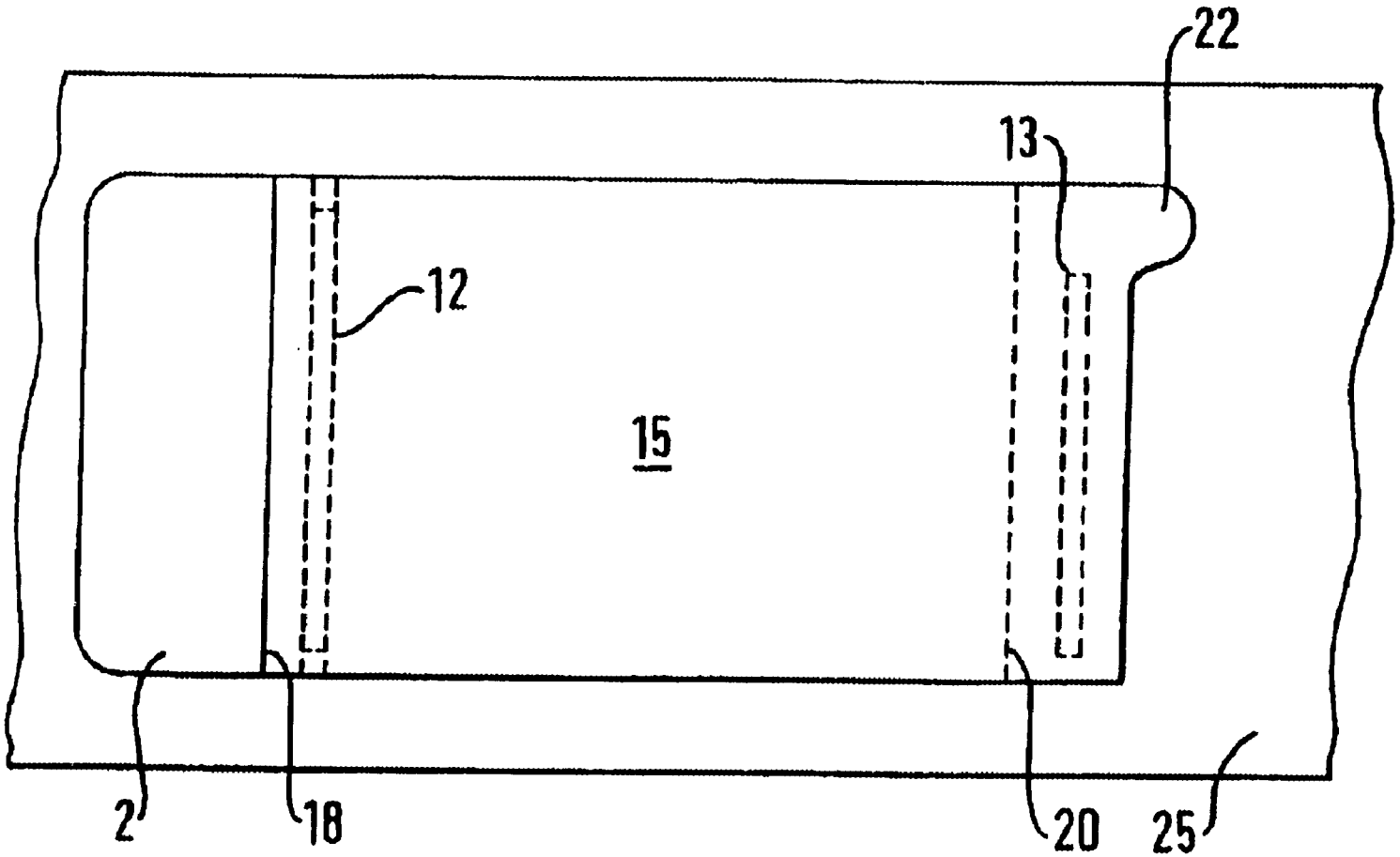
FIG. 1 Is a schematic plan view of an adhesive label in accordance with the present invention.

FIG. 1 shows an adhesive label manufactured according to the method described above on a web of silicone coated release material 25. The adhesive label consists of a base label 2 onto which a folded leaflet 15 is adhered. The folded edge 18 of the leaflet is preferably located inboard of the edge of the base label. Alternatively, if desired, the folded edge 45 may be coincident or immediately adjacent with an edge of the base label. The longitudinally extending edges of the folded leaflet and the base label are coincident in FIG. 1 but this need not be the case where it is desired to have a slightly larger base label, for example. In this case separate die cutting of the folded leaflet and the base label would be required. The free end region 19 of the top panel overlies the line of resealable adhesive 13 which holds only a portion of the free end region in a closed state against the release material Beyond the line of resealable adhesive 13 the free end region 19 terminates in a tab 22 that is unadhered to the release material.

Tear lines, that may include perforations, may be provided in one or more of the panels of the folded leaflet.

Although the adhesive label described above includes a tab formed from the edge of the top panel of the folded leaflet, such a tab is not essential to the construction of the adhesive label. The free edge of the top panel may be cut to any desired shape whilst ensuring that at least a part of the free edge region of the top panel overlies the resealable adhesive. For example, the free edge of the top panel may lie parallel to the folded edge of the leaflet, a notch may be cut into the free edge of the top panel to provide easy access when lifting the free edge of the top panel or a similar tab or notch may be formed on a longitudinal edge of the top panel extending between the folded edge and the free edge.

Figure 7:
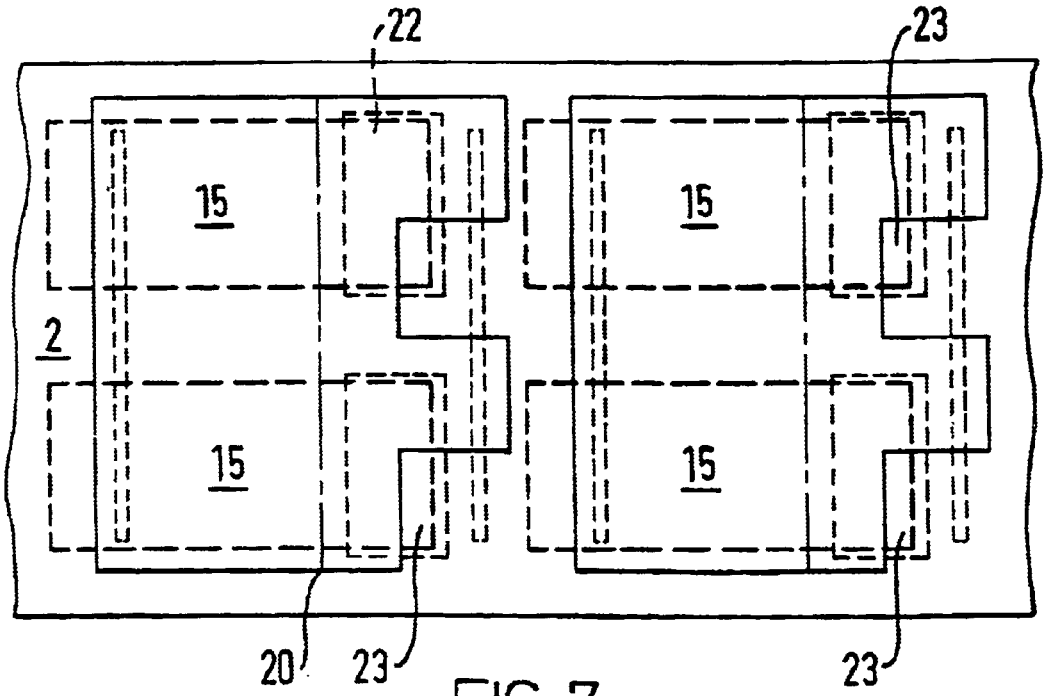
FIG. 7 shows schematically an alternative method of manufacturing an adhesive label incorporating an upper layer of laminar material.

Whilst the adhesive label described above consists of only a support label and a folded leaflet, it is envisaged that a plastics laminar material may be applied over part or all of the folded leaflet and/or the exposed portions of the support web and that the laminar material may be transparent and/or may be suitable for over-printing. Preferably, the plastics laminar material is applied after the folded leaflets have been adhered to the support web but before the die-cutting station 21. The laminar material is preferably self-adhesive and so adheres to the exposed upper surfaces of the support web 2, the folded leaflet 15 and the release material through the windows 5. The edges of the laminar material may be contiguous with the edges of the base label and the folded leaflet after die-cutting with the folded leaflet 15 held closed by the adherence of the free edge region 19 of the folded leaflet to the release material. Alternatively, the folded leaflet may be pre-cut as shown in FIG. 7 so that only a portion of the transverse width of each adhesive label projects across the window 5 to adhere to the line of adhesive 11. In this arrangement the line of resealable adhesive 13 may be omitted. Instead, the self-adhesive laminar material that overlies the base label and the folded leaflet adheres to the release material (identified by 23 in FIG. 7) and ensures the folded leaflet is held closed without the need for the free edge region 19 to have adhesive on its inward facing surface. With this arrangement again an unadhered tab or flap is provided to assist in the opening of the folded leaflet. In FIG. 7 the dashed line indicates the periphery of the die-cut adhesive labels.

Although in the above description it is the free edge regions of the folded leaflets 15 that overlie the windows 5, in an alternative arrangement it is envisaged that the folded edge or spine of the leaflet overlies the windows 5 and part of that portion of the leaflet that overlies the windows may be releasably adhered to the release material. With this arrangement the leaflet is folded so that it may be opened from underneath. For example, the bottom panel of the leaflet may be shorter than the top panel so that when the leaflet is secured to the support web the line of adhesive 12 adheres to the inner surface of the top panel leaving the lower panel unadhered to the support web. Thus, when opening the leaflet, the folded edge or spine of the leaflet is lifted away from the base label and the bottom panel is unfolded outwards.

With the method of manufacture described above the support web is not cut into individual base labels until the final die-cutting operation where all of the shaping of the adhesive label is performed together. This enables more complicated shapes to be produced that would be difficult if not impossible to produce where alignment between a pre-die-cut base label and a subsequent die cutting operation would be necessary. Furthermore, because only lines of adhesive are employed, the rear surface of the bottom panel and the upper surface of the base label may be used to present additional pre-printed information. This increases the total number of sheets available in the adhesive label. The use of lines of adhesive also ensures that the free edge region of the top panel may be easily grasped and the folded leaflet thereby opened by means of a tab or other unadhered portion.

What is claimed is:

1. A method of manufacturing adhesive labels including a base label and a multi-page leaflet secured thereto, the method comprising: providing a support web on a web of release material, the support web having a plurality of windows exposing portions of the web of release material therethrough; securing a plurality of multi-page leaflets to a top surface of the support web such that an end region of each multi-page leaflet overlies one or more windows; directly releasably adhering portions of said end regions of said multi-page leaflets to regions of the exposed portions of the web of release material by providing a resealable adhesive between said regions of the exposed portions of the web of release material and said end regions of said multi-page leaflets; and cutting the multi-page leaflets and the support web to define a plurality of adhesive labels each having a portion of the multi-page leaflet adjacent the web of release material.

2. A method as claimed in claim 1, wherein the multi-page leaflets are secured to the support web by one or more regions of adhesive.

3. A method as claimed in claim 1, wherein said directly releasably adhering portions of the end regions of the multi-page leaflets to regions of the exposed portions of the web of release material includes applying adhesive to regions of the release material exposed through the windows and releasably adhering portions of the end regions to the release material.

4. A method as claimed in claim 3, further comprising providing the end region of each of the multi-page leaflets with an unadhered tab portion that extends beyond said portion of the end region directly releasably adhered to the release material.

5. A method of manufacturing adhesive labels including a base label and a multi-page leaflet secured thereto, the method comprising: providing a support web on a web of release material, the support web having a plurality of windows exposing portions of the web of release material therethrough; securing a plurality of multi-page leaflets to a top surface of the support web such that an end region of each multi-page leaflet overlies one or more windows, directly releasably adhering portions of said end regions of said multi-page leaflets to regions of the exposed portions of the web of release material; and cutting the multi-page leaflets and the support web to define a plurality of adhesive labels each having a portion of the multi-page leaflet adjacent the web of release material; further comprising initial steps of providing a continuous support web on a web of release material, cutting a plurality of windows in the support web as far as the web of release material and disposing of the cut patches of the support web, wherein the cut patches are removed by passing the support web over a projecting edge with the release material facing towards the projecting edge.

6. A method as claimed in claim 5, wherein the support web is fed to the projecting edge such that the cut patches are removed from the supporting web with their adhesive surface uppermost.

7. A method as claimed in claim 1 further comprising applying a laminar material to exposed parts of the support web and each of the multi-page leaflets.

8. A method as claimed in claim 7, wherein the end region of the multi page leaflet that overlies one or more windows is shaped so as to only partly overlie the release material exposed through the one or more windows whereby the laminar material is adhered to portions of the release material that remain exposed.

9. A method as claimed in claim 1, wherein each of the multi-page leaflets has a spine end region and a free end region, and said end region that overlies the one or more windows comprises said free end region.

10. A method of manufacturing adhesive labels including a base label and a multi-page leaflet secured thereto, the method comprising: providing a support web on a web of release material, the support web having a plurality of windows exposing portions of the web of release material therethrough; securing a plurality of multi-page leaflets to a top surface of the support web such that an end region of each multi-page leaflet overlies one or more windows; directly releasably adhering portions of said end regions of said multi-page leaflets to regions of the exposed portions of the web of release material; and cutting the multi-page leaflets and the support web to define a plurality of adhesive labels each having a portion of the multi-page leaflet adjacent the web of release material; wherein each of the multi-page leaflets has a spine end region and a free end region, and said end region that overlies the one or more windows comprises said spine end region.

11. An adhesive label assembly comprising a web of release material, a plurality of base labels formed from a support web and releasably adhered to the web of release material, a multi-page leaflet disposed on each one of the plurality of base labels such that an end region of each multi-page leaflet extends beyond an edge of the respective base label to overlie a portion of the release material, the end region of the multi-page leaflet comprising a free end region that is continuous with said multi-page leaflet and is remote from the respective base label, and wherein a portion of the end region between said free-end region and the portion of said multi-page leaflet that overlies the respective base label is directly releasably held to the release material by a resealable adhesive provided between said portion of said end region of each of said multi-page leaflets and said release material.

12. An adhesive label assembly as claimed in claim 11, wherein the multi-page leaflets are adhered to respective base labels.

13. An adhesive label assembly as claimed in claim 11, wherein exposed upper surfaces of the base labels and the multi-page leaflets are covered in a laminar material.

14. An adhesive label assembly as claimed in claim 11, wherein said portion of the end region of each of the multi-page leaflets that is directly held to the release material is releasably adhered to the release material.

15. An adhesive label assembly as claimed in claim 13, wherein the laminar material overlies and is releasably adhered to the release material.

16. An adhesive label assembly as claimed in claim 14, wherein each of the multi-page leaflets is provided with an unadhered tab.

17. A method of manufacturing an adhesive label assembly comprising: providing a web of release material with a web of label material adhered thereto; cutting a plurality of patches through the web of label material to the release material; and removing the patches to form windows exposing regions of the release material; wherein the patches are removed from the web of label material by passing the web of release material with the web of label material adhered thereto about a projecting edge.

18. A method as claimed in claim 17, wherein the web of release material with the web of label material adhered thereto travels from a lower leading surface of the projecting edge to an upper supporting surface whereby the patches are removed with adhesive uppermost.

19. An adhesive label comprising a base label and a multi-page leaflet secured thereto when manufactured by the method as claimed in claim 1.

* * * * *